US011673150B2

(12) United States Patent
Miller

(10) Patent No.: US 11,673,150 B2
(45) Date of Patent: Jun. 13, 2023

(54) SYSTEM AND METHODS FOR LIQUID DISPERSION AND RINSING

(71) Applicant: Jason Michael Miller, Gilbert, AZ (US)

(72) Inventor: Jason Michael Miller, Gilbert, AZ (US)

( * ) Notice: Subject to any disclaimer, the term of this patent is extended or adjusted under 35 U.S.C. 154(b) by 196 days.

(21) Appl. No.: 16/931,055

(22) Filed: Jul. 16, 2020

(65) Prior Publication Data

US 2020/0360940 A1 Nov. 19, 2020

Related U.S. Application Data

(63) Continuation-in-part of application No. 15/931,087, filed on May 13, 2020, now abandoned.

(60) Provisional application No. 62/847,133, filed on May 13, 2019.

(51) Int. Cl.

| | |
|---|---|
| ***B05B 1/20*** | (2006.01) |
| ***B05B 1/30*** | (2006.01) |
| ***B08B 3/02*** | (2006.01) |
| ***B05B 7/28*** | (2006.01) |

(52) U.S. Cl.

CPC ..... *B05B 1/205* (2013.01); *B05B 1/3026* (2013.01); *B05B 7/28* (2013.01); *B08B 3/02* (2013.01); *B08B 2203/0217* (2013.01)

(58) Field of Classification Search

CPC ..... B05B 1/205; B05B 1/3026; B05B 7/28; B08B 3/02; B08B 2203/0217

USPC .... 239/273, 280.5, 281, 310, 315, 525, 530, 239/532, 536, 548, 550, 566, 575, 280, 239/251, 551, 722, 754; 4/601

See application file for complete search history.

(56) References Cited

U.S. PATENT DOCUMENTS 1,758,115 A * 5/1930 Kelly ..... E03C 1/06 239/536
2,177,219 A * 10/1939 Lewis ..... A47L 15/23 239/251
5,564,139 A * 10/1996 Shorr ..... A47K 3/283 4/601
5,678,258 A * 10/1997 Healy ..... E03C 1/0408 4/601
5,983,419 A * 11/1999 Carroll ..... A47K 3/285 4/601
5,996,142 A * 12/1999 Colman ..... A47K 3/285 4/601

(Continued)

*Primary Examiner* — Steven J Ganey

(74) *Attorney, Agent, or Firm* — Michelle L. Gross, P.C.

(57) ABSTRACT

A liquid dispersion device comprising an elongated dispersion body comprising a first end extending in a first direction and forming an elongated dispersion body comprising a first end positioned at an acute angle relative to a longitudinal axis of the elongated dispersion body, a second end positioned at an obtuse angle relative to the longitudinal axis of the elongated dispersion body, a plurality of nozzles extending outwardly from a forward surface of the dispersion body and a source connector on a rear surface of the dispersion body, the source connector in fluid communication with the plurality of nozzles. A first nozzle among the plurality of nozzles is positioned on the forward surface of the dispersion body at the first end of the dispersion body and a second nozzle is positioned on the forward surface of the dispersion body at the second end of the dispersion body.

16 Claims, 7 Drawing Sheets

(56) References Cited

U.S. PATENT DOCUMENTS

| | | | | |
|---|---|---|---|---|
| 6,068,204 | A * | 5/2000 | Alexander | B05B 7/2443 239/273 |
| 6,378,791 | B1 * | 4/2002 | Perry | B05B 1/20 239/525 |
| 7,356,857 | B2 * | 4/2008 | Rosenberg | E03C 1/0408 239/536 |
| 10,851,528 | B2 * | 12/2020 | Wang | B05B 1/185 |
| 2010/0051071 | A1 * | 3/2010 | Calhoun | B08B 13/00 239/548 |

* cited by examiner

SYSTEM AND METHODS FOR LIQUID DISPERSION AND RINSING

CROSS-REFERENCE TO RELATED APPLICATIONS

This application is a continuation in part of U.S. application Ser. No. 15/931,087, entitled "System and Methods for Liquid Dispersion and Rinsing" to Jason Michael Miller, filed on May 13, 2020 which claims priority to U.S. Provisional Ser. No. 62/847,133, entitled "Liquid Dispersion and Rinsing Device," to Jason Michael Miller, filed on May 13, 2019, the contents of which are hereby incorporated by reference in their entirety.

BACKGROUND

1. Technical Field

Aspects of this document relate generally to systems and methods of dispersing liquid for the purpose of rinsing and removing contaminants.

2. Background Art

Any discussion of the related art throughout the specification should in no way be considered as an admission that such related art is widely known or forms part of common general knowledge in the field.

Currently there are several solutions for liquid dispersion to remove unwanted substance from objects or subjects. Some of these solutions attempt to generally rinse objects or subjects with a top down motion or with a single hand-held liquid projection device, such as for example, a hose, but these solutions fail to meet the needs of the industry because they rinse at angles that contaminate objects or subjects beneath the outer surface, they push unwanted substances into the material to be rinsed due to improper pressure, they require an operator to manipulate the device and they are not easily and quickly deployable. Other solutions attempt to create a dispersion of water in a circle either vertically or horizontally around a subject or object, but these solutions are similarly unable to meet the needs of the industry because this does not direct liquid streams in a strategic pattern, is difficult to deploy, is difficult to manipulate, requires complex resources and does not consider operating pressure and/or dispersion patterns.

SUMMARY

Implementations of a dispersion device may comprise an elongated dispersion body comprising a first end positioned at an acute angle relative to a longitudinal axis of the elongated dispersion body, a second end positioned at an obtuse angle relative to the longitudinal axis of the elongated dispersion body, a plurality of nozzles extending outwardly from a forward surface of the dispersion body, and a source connector on a rear surface of the dispersion body, the source connector in fluid communication with the plurality of nozzles, wherein a first nozzle among the plurality of nozzles is positioned on the forward surface of the dispersion body at the first end of the dispersion body and a second nozzle is positioned on the forward surface of the dispersion body at the second end of the dispersion body.

Particular aspects may include one or more of the following features. The source connector may further comprise a shut-off valve configured to stop fluid flow to the elongated dispersion body. The dispersion body may comprise a shut-off valve configured to stop flow of a fluid to one or more nozzles from among the plurality of nozzles. The dispersion device may further comprise a bracket assembly configured to secure the dispersion device to an upright structure. The dispersion device may further comprise a discharge assembly in fluid communication with a fluid source and the source connector. The discharge assembly may further comprise a discharge assembly body, a flow valve, and a flow valve handle. The dispersion device of may further comprise a proportioning canister proximal the discharge assembly, the proportioning canister in fluid communication with the discharge assembly and the source connector. The proportioning canister may comprises a detergent cartridge therein. The proportioning canister may further comprise a filter positioned downstream the detergent cartridge relative to a flow of a fluid from the discharge assembly to the source connector. The filter may be concave and comprise a plurality of openings therein.

Implementations of a method of liquid dispersion may comprise coupling a source connector positioned on a rear surface of an elongated dispersion body of a dispersion device to a source of a liquid, the elongated dispersion body further comprising a first end positioned at an acute angle relative to a longitudinal axis of the elongated dispersion body and a second end positioned at an obtuse angle relative to the longitudinal axis of the elongated dispersion body. The method may further comprise enabling flow of the liquid to a plurality of nozzles in fluid communication with the source connector, the plurality of nozzles extending outwardly from a forward surface of the dispersion body, wherein a first nozzle among the plurality of nozzles is positioned on the forward surface of the dispersion body at the first end of the dispersion body and a second nozzle is positioned on the forward surface of the dispersion body at the second end of the dispersion body.

Particular aspects may comprise one or more of the following features. The method may further comprise stopping liquid flow to the elongated dispersion body by closing a shut-off valve on the source connector. The method may further comprise stopping liquid flow to one or more nozzles from among the plurality of nozzles by closing a shut-off valve on the elongated dispersion body. The method may further comprise securing the dispersion device to an upright structure using a bracket assembly. The method may further comprise enabling liquid flow through a discharge assembly that is in fluid communication with a liquid source and the source connector. Enabling the liquid flow through the discharge assembly may further comprise opening a flow valve using a flow valve handle. The method may further comprise positioning a proportioning canister proximal the discharge assembly, the proportioning canister in fluid communication with the discharge assembly and the source connector. The method may further comprise inserting a detergent cartridge into the proportioning canister. The method may further comprise positioning a filter within the proportioning canister downstream the detergent cartridge relative to a flow of a liquid from the discharge assembly to the source connector. The filter may be concave and comprise a plurality of openings therein.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographer, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of post-AIA 35 U.S.C. § 112(f). Thus, the use of the words "function," "means" or "step" in the Detailed Description, Drawings, or Claims is not intended to somehow indicate a desire to invoke the special provisions of post-AIA 35 U.S.C. § 112(f), to define the invention. To the contrary, if the provisions of post-AIA 35 U.S.C. § 112(f) are sought to be invoked to define the claimed disclosure, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of post-AIA 35 U.S.C. § 112(f). Moreover, even if the provisions of post-AIA 35 U.S.C. § 112(f) are invoked to define the claimed disclosure, it is intended that the disclosure not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
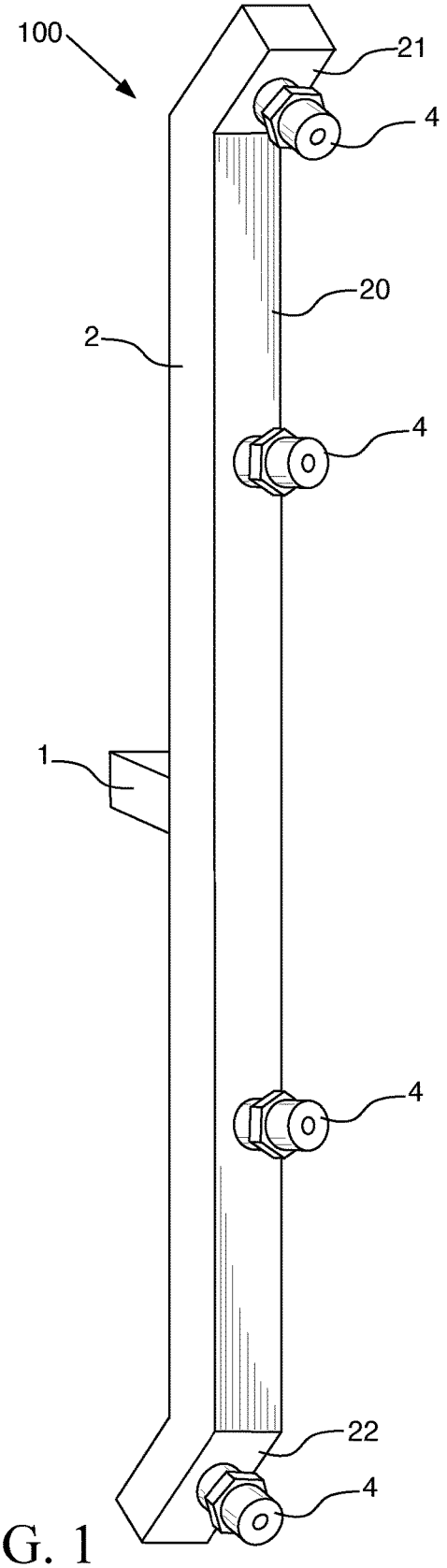
FIG. 1 provides a front perspective view of an embodiment of a liquid dispersion device.

Unless otherwise defined, all technical and scientific terms used herein have the same meaning as commonly understood by one of ordinary skill in the art to which this invention belongs. Although methods and materials similar to or equivalent to those described herein can be used in the practice or testing of the liquid dispersion and rinsing system, suitable methods and materials are described herein. All publications, patent applications, patents, and other references mentioned herein are incorporated by reference in their entirety to the extent allowed by applicable law and regulations. The liquid dispersion device may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. As used herein, phrases such as "make contact with," "connected to," "coupled to," "touch," "interface with" and "engage" may be used interchangeably. It is to be noted that the terms "connected", "connector", "connection", "coupled", "coupling", and "coupler" are intended to be used interchangeably throughout this disclosure.

The features, structures, or characteristics of the invention described throughout this specification may be combined in any suitable manner in one or more embodiments. For example, the usage of the phrases "exemplary embodiments", "some embodiments", "some implementations," or other similar language refers to the fact that a particular feature, structure, or characteristic described in connection with the embodiment may be included in at least one embodiment of the present invention. Thus, appearances of the phrases "exemplary embodiments", "in some embodiments", "in other embodiments" or other similar language, throughout this specification do not necessarily all refer to the same group of embodiments, and the described features, structures, or characteristics may be combined in any suitable manner in one or more embodiments.

Implementations of the liquid dispersion device disclosed herein may be used to rinse unwanted substances from objects or subjects in a way as to move the material down and away without pushing unwanted substances further into the object or subject and rinse unwanted substances in the desired direction to minimize contamination of secondary objects, and once to the ground, move unwanted substances away from the object or subject being rinsed. Furthermore, the device may be used to cool and moisturize at a measurable rate. Still further, the liquid dispersion device that may be used to minimize unwanted vapor associated with unwanted substances on an object or subject. This disclosure produces a low to moderate and stable volume of liquid to keep from embedding unwanted substances into the material or body being rinsed.

Figure 2:
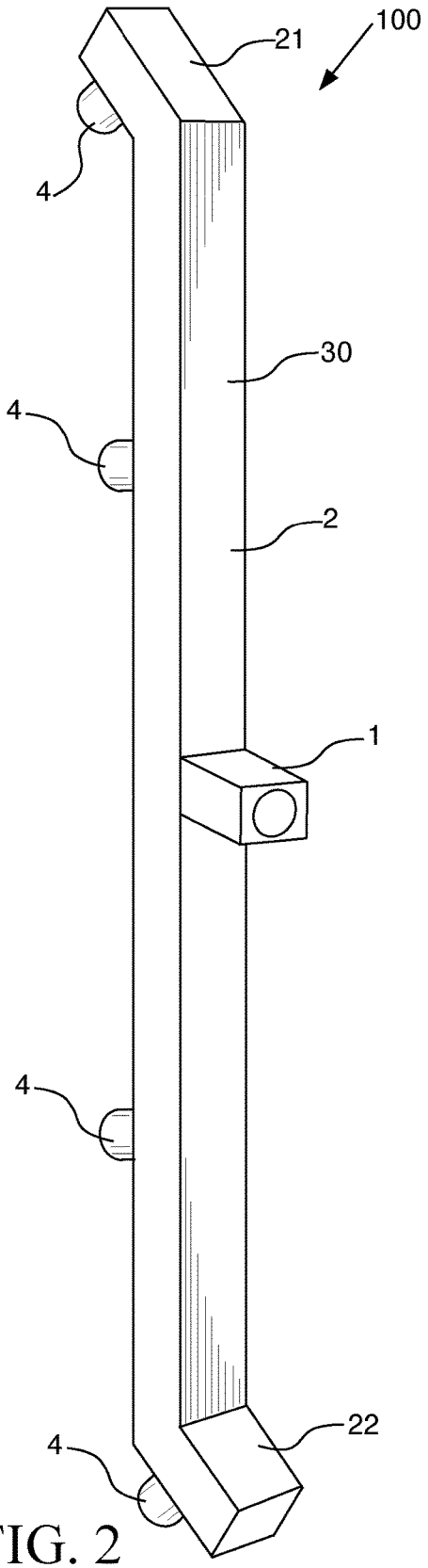
FIG. 2 provides a rear perspective view of an embodiment of the liquid dispersion device.

As shown in FIGS. 1-2, implementations of a dispersion device 100 are configured to move a fluid such as a liquid, from a liquid source and direct the liquid into an elongated dispersion body 2 comprising a void therein and then to one or more dispersion nozzles 4 which rinse unwanted substances from, but not limited to, objects, clothing and bodies. As shown in the embodiment of FIGS. 1-2, a plurality of nozzles 4 is positioned such as to extend outwardly from a forward surface 20 of the elongated dispersion body 2. The spray pattern and discharge volume (based mainly on source pressure) of the plurality of nozzles 4 may move liquid from the nozzles in a full cone or full rectangle pattern which may overlap to form a continuous rinsing pattern. While four nozzles are illustrated, it is contemplated that any appropriate number of nozzles may be used.

Figure 3:
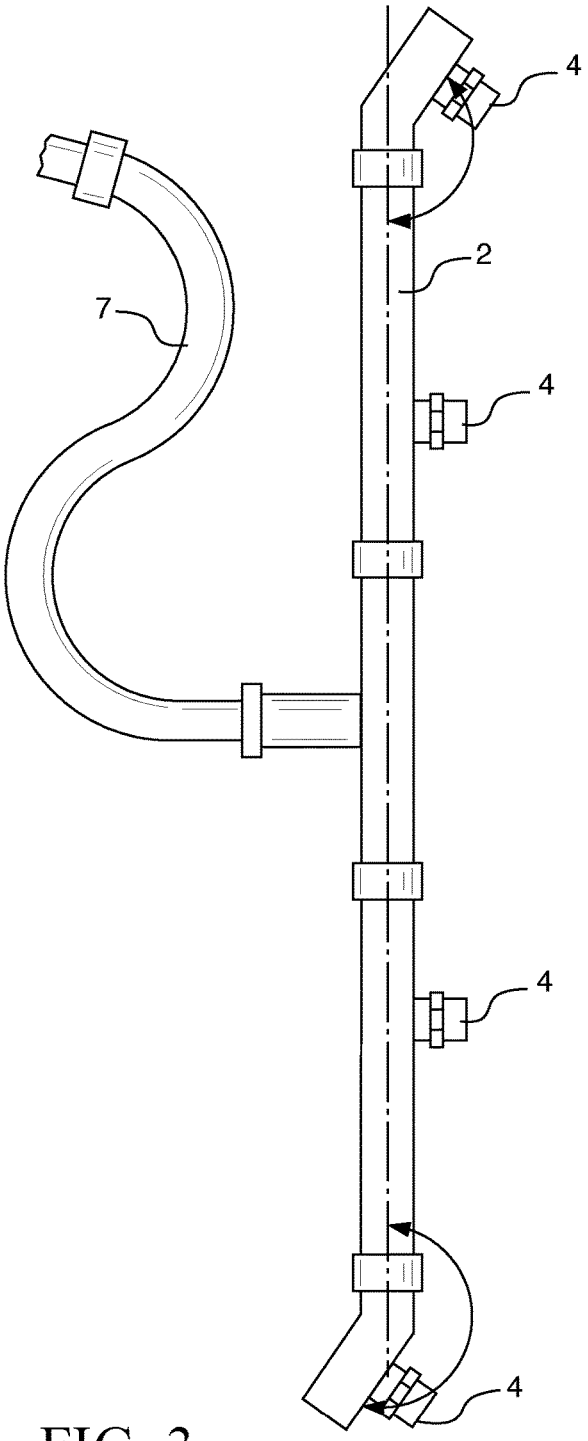
FIG. 3 provides a side view of an embodiment of the liquid dispersion device.
Figure 4:
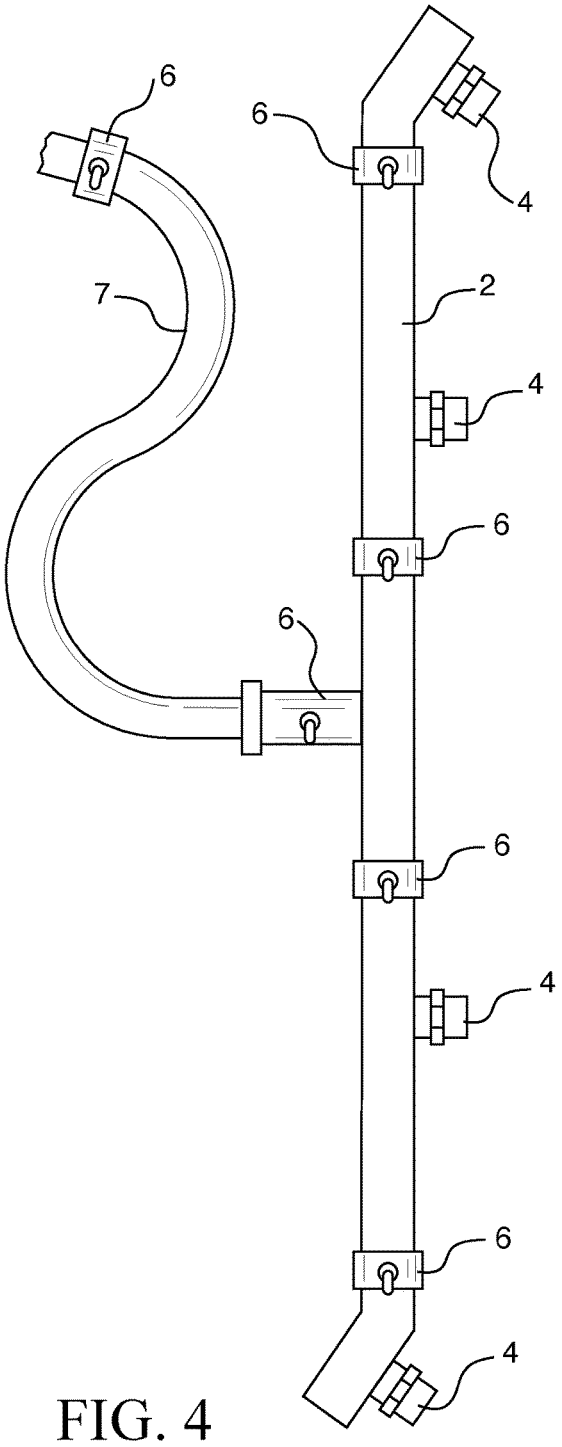
FIG. 4 provides a perspective view of an embodiment of the liquid dispersion device comprising a shut-off valve.

The elongated dispersion body 2 may comprise a first end 21 that extends forward at an acute angle relative to a longitudinal axis of the elongated dispersion body 2 as shown in FIGS. 3-4. The elongated dispersion body 2 may further comprise a second end 22 distal from the first end 21 and which extends at an obtuse angle relative to the longitudinal axis of the elongated dispersion body 2. The extension of the first 21 and second 22 ends of the dispersion body at such angles allows for one or more nozzles 4 placed at each of the first 21 and second 22 ends to be positioned at a downward angle when the dispersion device 100 is vertically oriented for use which keeps unwanted substances from moving upward and/or back onto the object or subject thereby minimizing the likelihood of material, items or bodies underneath the surface of the subject or object being rinsed being exposed to unwanted substances. These downward pointing nozzles also assist in the downward movement of the unwanted substance as well as the movement of unwanted substances away from the object or subject being rinsed once those unwanted substances have reached the ground area.

It is contemplated that the first end 21 of the elongated dispersion body 2 may be positioned within any of the following ranges of angles relative to the longitudinal axis of the elongated dispersion body 2: about 10 degrees to about 60 degrees; about 10 degrees to about 55 degrees; about 10 degrees to about 50 degrees; about 10 degrees to about 45 degrees; about 10 degrees to about 40 degrees; about 10 degrees to about 35 degrees; about 10 degree to about 30 degrees; about 10 degrees to about 25 degrees; about 10 degrees to about 20 degrees; about 10 degrees to about 15 degrees; about 15 degrees to about 60 degrees; about 15 degrees to about 55 degrees; about 15 degrees to about 50 degrees; about 15 degrees to about 45 degrees; about 15 degrees to about 40 degrees; about 15 degrees to about 35 degrees; about 15 degrees to about 30 degrees; about 15 degrees to about 25 degrees; about 15 degrees to about 20 degrees; about 20 degrees to about 60 degrees; about 20 degrees to about 55 degrees; about 20 degrees to about 50 degrees; about 20 degrees to about 45 degrees; about 20 degrees to about 40 degrees; about 20 degrees to about 35 degrees; about 20 degrees to about 30 degrees; about 20 degrees to about 25 degrees; about 25 degrees to about 60 degrees; about 25 degrees to about 55 degrees; about 25 degrees to about 50 degrees; about 25 degrees to about 45 degrees; about 25 degrees to about 40 degrees; about 25 degrees to about 35 degrees; about 25 degrees to about 30 degrees; about 30 degrees to about 60 degrees; about 30 degrees to about 55 degrees; about 30 degrees to about 50 degrees; about 30 degrees to about 45 degrees; about 30 degrees to about 40 degrees; about 30 degrees to about 35 degrees; about 35 degrees to about 60 degrees; about 35 degrees to about 55 degrees; about 35 degrees to about 50 degrees; about 35 degrees to about 45 degrees; about 35 degrees to about 40 degrees; about 40 degrees to about 60 degrees; about 40 degrees to about 55 degrees; about 40 degrees to about 50 degrees; about 40 degrees to about 45 degrees; about 45 degrees to about 60 degrees; about 45 degrees to about 55 degrees; about 45 degrees to about 50 degrees; about 50 degrees to about 60 degrees; about 50 degrees to about 55 degrees; and about 55 degrees to about 60 degrees. It is also contemplated that the second end 21 of the elongated dispersion body 2 may be positioned within any of the following ranges of angles relative to the longitudinal axis of the elongated dispersion body 2: about 100 degrees to about 150 degrees; about 100 degrees to about 145 degrees; about 100 degrees to about 140 degrees; about 100 degrees to about 135 degrees; about 100 degrees to about 130 degrees; about 100 degrees to about 125 degrees; about 100 degrees to about 120 degrees; about 100 degrees to about 115 degrees; about 100 degrees to about 110 degrees; about 110 degrees to about 150 degrees; about 110 degrees to about 145 degrees; about 110 degrees to about 140 degrees; about 110 degrees to about 135 degrees; about 110 degrees to about 130 degrees; about 110 degrees to about 125 degrees; about 110 degrees to about 120 degrees; about 110 degrees to about 115 degrees; about 115 degrees to about 150 degrees; about 115 degrees to about 145 degrees; about 115 degrees to about 140 degrees; about 115 degrees to about 135 degrees; about 115 degrees to about 130 degrees; about 115 degrees to about 125 degrees; about 115 degrees to about 120 degrees; about 120 degrees to about 150 degrees; about 120 degrees to about 145 degrees; about 120 degrees to about 140 degrees; about 120 degrees to about 135 degrees; about 120 degrees to about 130 degrees; about 120 degrees to about 125 degrees; about 125 degrees to about 150 degrees; about 125 degrees to about 145 degrees; about 125 degrees to about 140 degrees; about 125 degrees to about 135 degrees; about 125 degrees to about 130 degrees; about 130 degrees to about 150 degrees; about 130 degrees to about 145 degrees; about 130 degrees to about 140 degrees; about 130 degrees to about 135 degrees; about 135 degrees to about 150 degrees; about 135 degrees to about 145 degrees; about 135 degrees to about 140 degrees; about 140 degrees to about 150 degrees; about 140 degrees to about 145 degrees; and about 145 degrees to about 150 degrees.

The dispersion device 100 further comprises a source connector 1 on a rear surface 30 of the elongated dispersion body 2. The source connector 1 is configured to couple with a flexible source conduit 7 such as a hose or other fluid conduit that allows a liquid to flow from the liquid source to the elongated dispersion body 2. While any appropriate materials may be used, it is contemplated that the elongated dispersion body 2 and the source connector 1 are comprised of a durable, corrosion-resistant material such as plastic, stainless steel, brass, or aluminum. While any appropriately sized source conduit 7 may be used, in some implementations, the source conduit 7 may be approximately ¾ inches in diameter and made of durable, corrosion-resistant and liquid sealed material which can handle high pressure of at least about 150 pounds per square inch (psi) but is also able to withstand higher pressures of up to about 400 psi. The source conduit 7 may be threaded on the side closest to the source with the necessary thread type to connect to the source output. The source conduit 7 may then be coupled to the elongated dispersion body 2 via the source connector 1 in a way that seals the liquid from escaping during the dispersion process. Where the source conduit 7 meets the dispersion body at the source connector 1, there may be adequate reinforcement to ensure durability and to minimize accidental disconnection from the dispersion body. The source conduit 7, once connected to the source and the elongated dispersion body 2, may allow liquid to be moved from the source discharge, through the source conduit 7 and into the elongated dispersion body 2.

As shown in FIG. 4, one or more shut-off valves 6 may be inserted at any point from the source connector 1, along the elongated dispersion body 2 or at the nozzles 4. The one or more valves 6 may allow for liquid to be isolated to or from any of the and nozzles 4. An educator or injector system (not shown) may be positioned anywhere along the source conduit 7 or the elongated dispersion body 2 to allow for a cleaning agent or any other substance to be injected into the liquid being dispersed. Additionally, a frame or stand structure may be utilized which will allow for the dispersion device to be moved and placed any distance away from the liquid source.

Figure 5:
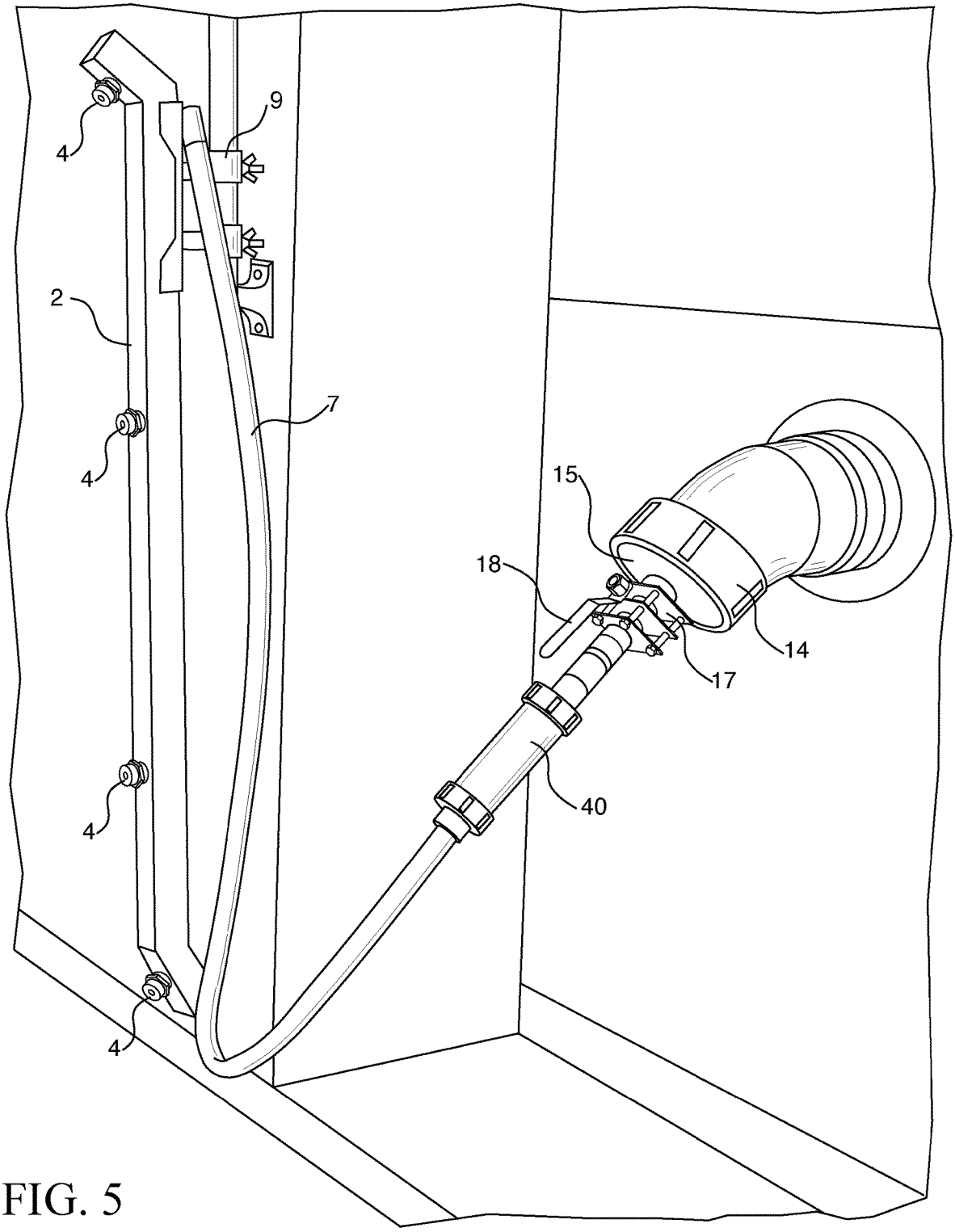
FIG. 5 provides a perspective view of an embodiment of the liquid dispersion device mounted to an emergency vehicle.
Figure 6:
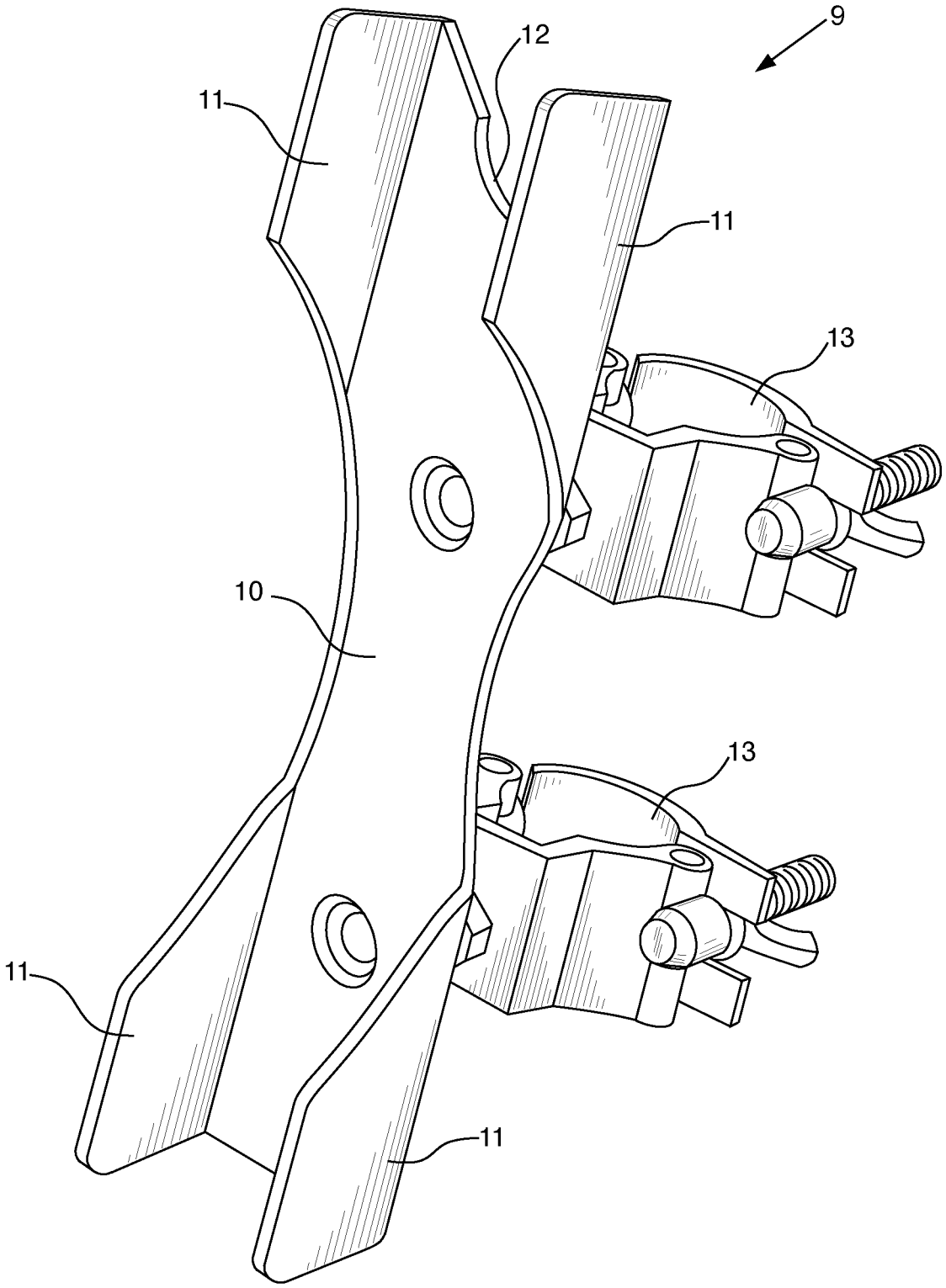
FIG. 6 provides a perspective view of an implementation of a bracket assembly for mounting the liquid dispersion device to an upright structure.
Figure 9:
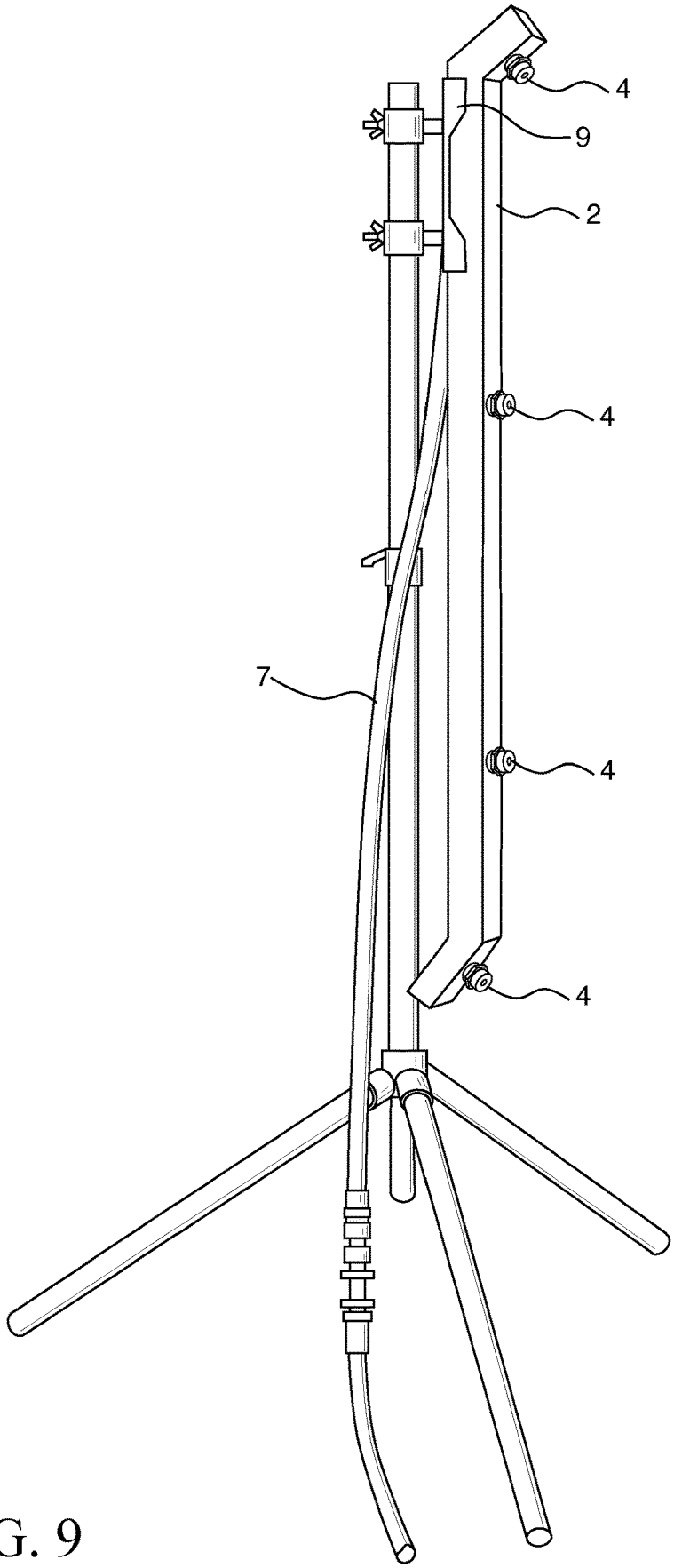
FIG. 9 provides a perspective view of an embodiment of the liquid dispersion device mounted on a tripod.

FIG. 6 provides a perspective view of a bracket assembly 9 for the liquid dispersion device 100 shown in accordance with an exemplary embodiment of the invention. The bracket assembly 9 may allow the liquid dispersion device 100 to be coupled to a vehicle, such as by non-limiting example, an emergency vehicle such as a fire truck as shown in FIG. 5 or to a moveable stand such as a tripod as shown in FIG. 9 to allow the liquid dispersion device 100 to be easily relocated. The bracket assembly 9, may comprise a rear support 10 which is comprised of a durable material designed to stabilize the rear portion of the liquid dispersion device limiting movement when mounted or in use. The bracket assembly 9 may further comprise one or more side supports 11 of the bracket assembly 9 which is comprised of a durable material designed to stabilize the side portions of the liquid dispersion device limiting movement when mounted or in use. A receiving pocket 12 at a first end of the bracket assembly 9, is adapted to receive the source connector 1 from the liquid dispersion device and/or the source conduit 7 and hold the liquid dispersion device 100 in place against the rear support 10 and the side supports 11 when mounted or in use. The bracket assembly 9 may further comprise one or more mounting contacts 13 which may extend outward from the rear support 10. The one or more mounting contacts 13 are comprised of a durable material to allows the bracket assembly 9 to be secured to a fixed apparatus allowing the liquid dispersion device to be stabilized and stationary when mounted and in use.

Figure 7:
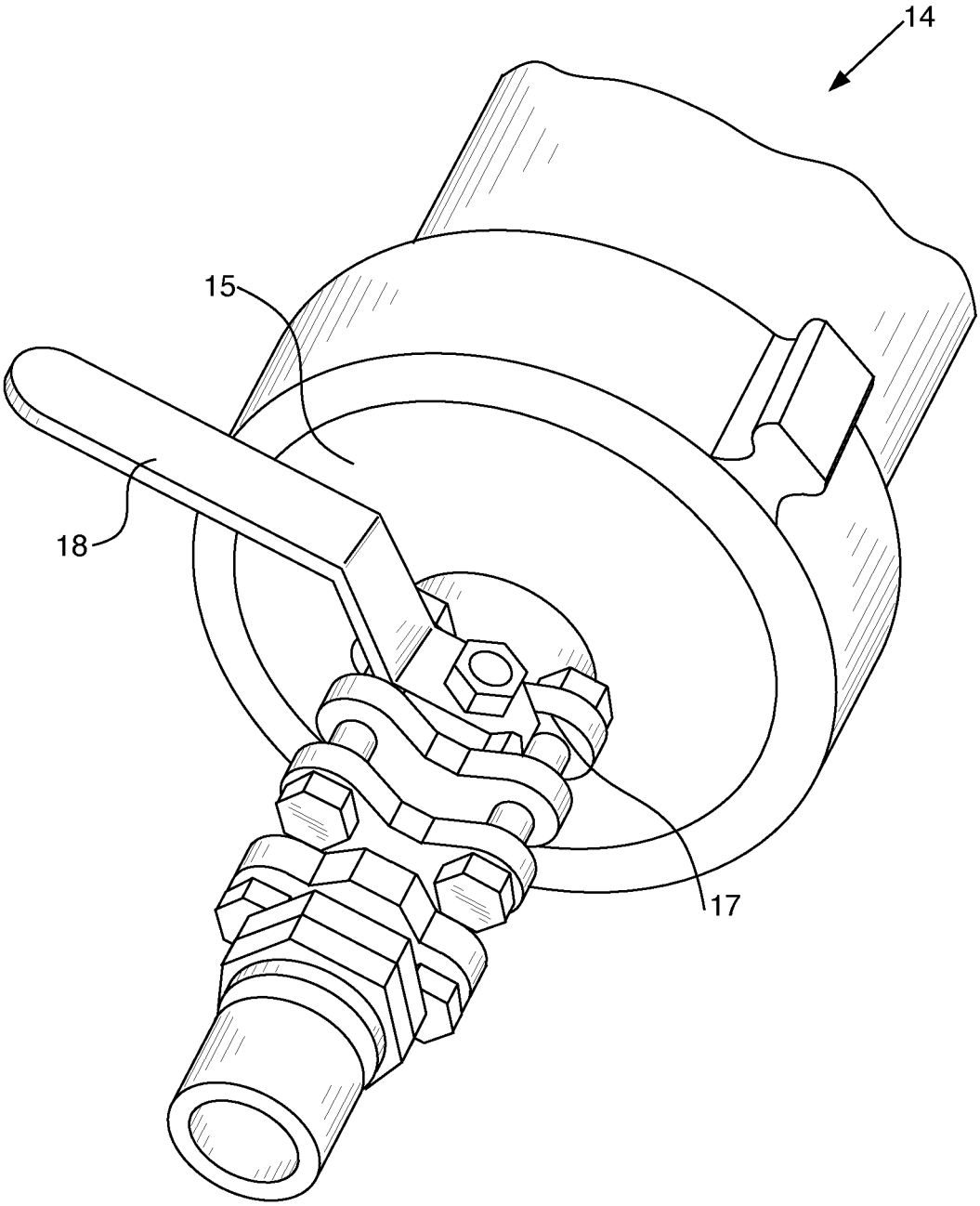
FIG. 7 provides a front perspective view of an implementation of a discharge assembly for the liquid dispersion device.

FIG. 7 provides a perspective view, of a discharge assembly 14 for some implementations of a liquid dispersion device 100 in accordance with an exemplary embodiment of the invention. The discharge assembly 14 may be comprised of a body 15, a flow valve 17, and a flow valve handle 18. It is contemplated that any of the aforementioned components may be comprised of a durable corrosion-resistant material which allow the discharge assembly to be secured to a liquid source and directed to the source connector 1 of the liquid dispersion device. An opening within the discharge assembly 14 is adapted to alternatively allow liquid to flow from the liquid source through the source conduit 7 and into the liquid dispersion device 100 and to block the flow of liquid from the liquid source to the source conduit 7. While it is contemplated that any appropriate flow valve may be used, as shown in the exemplary embodiment of FIG. 7 which is shown in use in FIG. 5, when the flow valve handle 18 is positioned perpendicular to the flow of liquid through the control valve blocks, the flow of liquid through the control valve is blocked and when the flow valve handle 18 is moved parallel to the flow of liquid through the control valve, liquid is allowed to flow through the flow valve.

Figure 8:
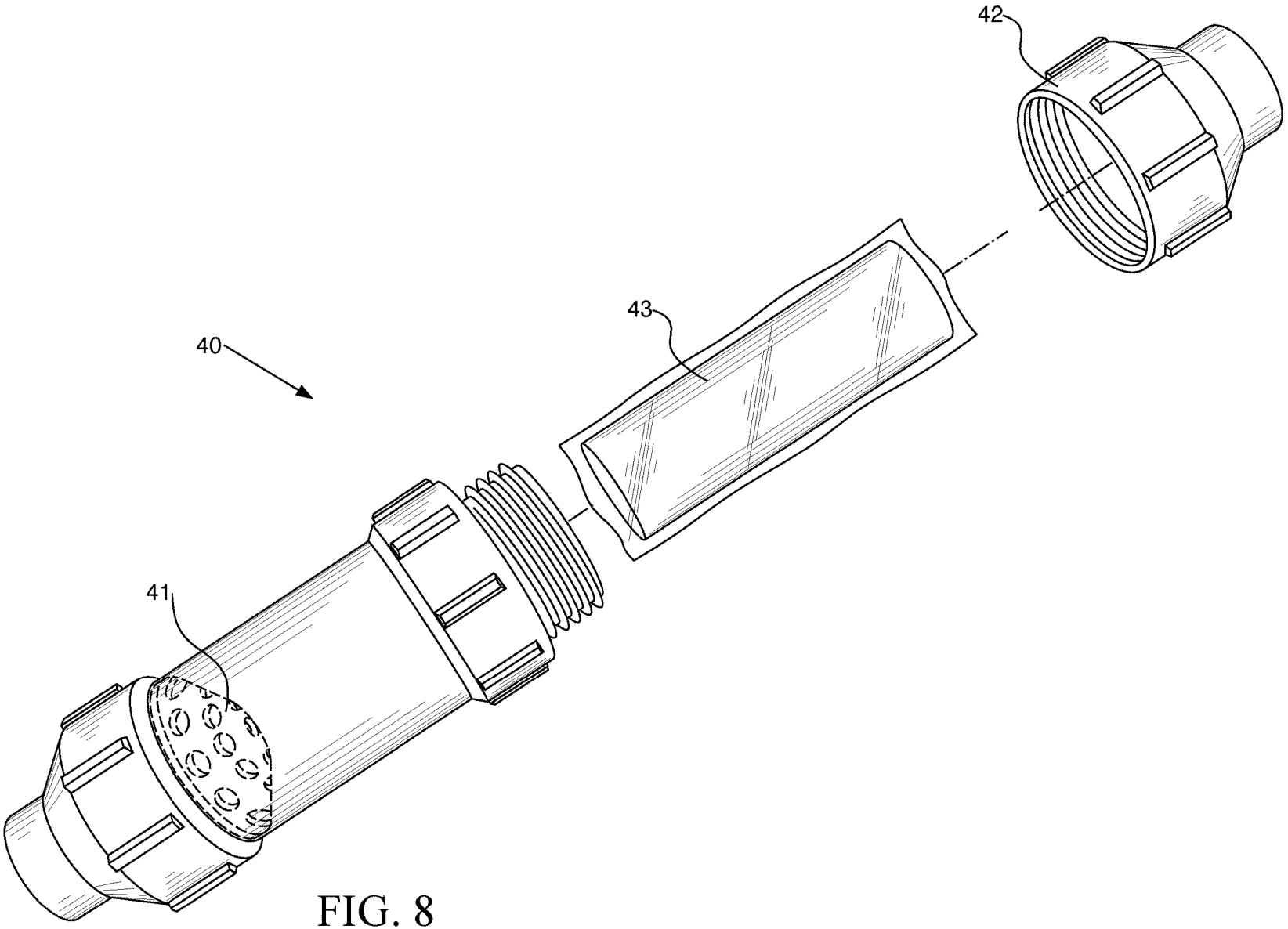
FIG. 8 provides an exploded view of a proportioning canister, detergent cartridge, and filter.

FIG. 8 provides an exploded view of a proportioning canister 40, detergent cartridge 43, and filter 44 which is shown in use in FIG. 5. While the proportioning canister 40 may be used anywhere along the source conduit 7, in some embodiments, the proportioning canister 40 may be located proximal the discharge assembly 14. As shown in FIG. 8, the proportioning canister body 41 may be separated from the proportioning canister top 42 and a detergent cartridge 43 containing any suitable detergent or moisturizing substance may be inserted therein. The proportioning canister 40 allows the detergent to be released at a controlled rate as liquid from the source flows through the proportioning canister 40. In some embodiments, a filter 44 may be placed into the proportioning canister 40 at a location that is downstream from the detergent cartridge 43 relative to the flow of liquid from the source through the canister 40. While any effectively shaped filter may be used, in some embodiments, the filter may have a concave shape and a plurality of opening to prevent the detergent cartridge 43 from laying flat against the filter and obstructing liquid flow through the canister 40.

While any appropriate dimensions are contemplated here, in some embodiments, when positioned vertically, some implementations of the liquid dispersion device 100 may measure approximately 40 inches tall, approximately 1½ inches to about 2 inches outside diameter and approximately 3-10 inches deep. In some embodiments, the inside diameter may be approximately ¾ inches to about 1 inch in diameter. The orifices of some embodiments of this device that are designed to receive nozzles may be approximately ¾ inch in diameter and may be threaded in a tapered way to receive tapered ½ inch national pipe thread. The nozzles of some embodiments may be BETE WL-6 nozzles and may produce a liquid dispersion pattern of 60 degrees with a full cone pattern once the liquid leaves the nozzles.

Embodiments of this disclosure may be fastened with high-strength materials such as but not limited to tapered threaded materials, high density materials, high thickness materials and where needed is welded, glued or molded to create sealed and high strength connections.

Embodiments of this disclosure may provide nozzles with specific discharge parameters so that the volume of flow is governed with an increase in pressure. Additionally, the nozzles may have wide discharge orifices to minimize clogging and create a uniform and fully filled liquid pattern which maximizes unwanted substance rinsing and removal. The nozzles also are strategically placed in distances from each other to provide a continuous pattern with maximum coverage area. The nozzles are also designed with a dispersion pattern specific in width to overlap with adjacent nozzles and create a continuous pattern with maximum coverage area.

In places where the description above refers to particular implementations of systems and methods for liquid dispersion, it should be readily apparent that a number of modifications may be made without departing from the spirit thereof and that these implementations may be applied to other to systems and techniques for liquid dispersion and rinsing devices and techniques.

What is claimed is:

1. A dispersion device comprising:

an elongated dispersion body comprising:

a first end positioned at an acute angle relative to a longitudinal axis of the elongated dispersion body;

a second end positioned at an obtuse angle relative to the longitudinal axis of the elongated dispersion body;

a plurality of nozzles extending outwardly from a forward surface of the elongated dispersion body; and a source connector on a rear surface of the elongated dispersion body, the source connector in fluid communication with the plurality of nozzles;

wherein a first nozzle among the plurality of nozzles is positioned on the forward surface of the elongated dispersion body at the first end of the elongated dispersion body and a second nozzle is positioned on the forward surface of the elongated dispersion body at the second end of the elongated dispersion body; and wherein at least one of the following:

the source connector further comprises a shut-off valve configured to stop fluid flow to the elongated dispersion body; and the elongated dispersion body comprises a shut-off valve configured to stop fluid flow to one or more nozzles from among the plurality of nozzles.

2. The dispersion device of claim 1, further comprising a bracket assembly configured to secure the dispersion device to an upright structure.

3. The dispersion device of claim 1, further comprising a discharge assembly in fluid communication with a fluid source and the source connector.

4. The dispersion device of claim 3 wherein the discharge assembly further comprises a discharge assembly body, a flow valve, and a flow valve handle.

5. The dispersion device of claim 3 further comprising a proportioning canister proximal the discharge assembly, the proportioning canister in fluid communication with the discharge assembly and the source connector.

6. The dispersion device of claim 5 wherein the proportioning canister comprises a detergent cartridge therein.

7. The dispersion device of claim 6 wherein the proportioning canister further comprises a filter positioned downstream the detergent cartridge relative to a flow of a fluid from the discharge assembly to the source connector.

8. The dispersion device of claim 7, wherein the filter is concave and comprises a plurality of openings therein.

9. A method of liquid dispersion comprising:

coupling a source connector positioned on a rear surface of an elongated dispersion body of a dispersion device to a source of a liquid, the elongated dispersion body further comprising:

a first end positioned at an acute angle relative to a longitudinal axis of the elongated dispersion body; and a second end positioned at an obtuse angle relative to the longitudinal axis of the elongated dispersion body;

enabling flow of the liquid to a plurality of nozzles in fluid communication with the source connector, the plurality of nozzles extending outwardly from a forward surface of the dispersion body, wherein a first nozzle among the plurality of nozzles is positioned on the forward surface of the dispersion body at the first end of the dispersion body and a second nozzle is positioned on the forward surface of the dispersion body at the second end of the dispersion body; and performing at least one of the following steps:

stopping liquid flow to the elongated dispersion body by closing a shut-off valve on the source connector; and stopping liquid flow to one or more nozzles from among the plurality of nozzles by closing a shut-off valve on the elongated dispersion body.

10. The method of claim 9, further comprising securing the dispersion device to an upright structure using a bracket assembly.

11. The method of claim 9, further comprising enabling liquid flow through a discharge assembly that is in fluid communication with a liquid source and the source connector.

12. The method of claim 11 wherein enabling the liquid flow through the discharge assembly further comprises opening a flow valve using a flow valve handle.

13. The method of claim 11 further comprising positioning a proportioning canister proximal the discharge assembly, the proportioning canister in fluid communication with the discharge assembly and the source connector.

14. The method of claim 13 further comprising inserting a detergent cartridge into the proportioning canister.

15. The method of claim 14 further comprising positioning a filter within the proportioning canister downstream the detergent cartridge relative to a flow of a liquid from the discharge assembly to the source connector.

16. The method of claim 15, wherein the filter is concave and comprises a plurality of openings therein.

* * * * *